US006153970A

United States Patent [19]

Chen et al.

[11] Patent Number: 6,153,970

[45] Date of Patent: Nov. 28, 2000

[54] COLOR CRT ELECTRON GUN WITH ASYMMETRIC AUXILIARY BEAM PASSING APERTURE

[75] Inventors: Hsing-Yao Chen, Barrington, Ill.; Yu Kun Ma, Yangmei, Taiwan

[73] Assignee: Chunghwa Picture Tubes, Ltd., Yangmei/Taoyuan, Taiwan

[21] Appl. No.: 09/063,092

[22] Filed: Apr. 20, 1998

[51] Int. Cl.[7] ..... H01J 29/51

[52] U.S. Cl. ..... 313/412; 313/414

[58] Field of Search ..... 313/412, 414, 313/449; 315/15, 382.1

[56] References Cited

U.S. PATENT DOCUMENTS

| | | | |
|---|---|---|---|
| 5,027,043 | 6/1991 | Chen et al. | 313/412 |
| 5,036,258 | 7/1991 | Chen et al. | 313/414 |
| 5,164,640 | 11/1992 | Son et al. | 313/414 |
| 5,170,101 | 12/1992 | Gorski et al. | 313/412 |
| 5,182,492 | 1/1993 | Chen | 315/14 |
| 5,281,896 | 1/1994 | Bae et al. | 315/15 |
| 5,350,967 | 9/1994 | Chen | 313/412 |
| 5,430,349 | 7/1995 | New et al. | 313/412 |
| 5,488,265 | 1/1996 | Chen | 313/414 |
| 5,517,078 | 5/1996 | Sugawara et al. | 313/412 |
| 5,814,930 | 9/1998 | Watanabe et al. | 313/414 |

*Primary Examiner*—Michael H. Day

*Attorney, Agent, or Firm*—Emrich & Dithmar

[57] ABSTRACT

In a multi-stage, multi-beam electron gun of the common lens type for use in a color cathode ray tube (CRT), a charged grid in the prefocus lens of the electron gun is provided with three inline asymmetric beam passing apertures. The three asymmetric apertures may be either in the G4 grid, in the upper side of the G3 grid, or on the lower side of the G5 grid, i.e., in facing relation to the G4 grid, or may be incorporated in both the G3 and G5 grids. The small G3–G4 and G4–G5 spacing gives rise to isolation of the electron optic lenses of the two outer electron beams from that of the center electron beam allowing the asymmetric auxiliary apertures to asymmetrically and independently correct for electron beam astigmatism, i.e., the difference between the beam's horizontal and vertical focus voltage, and differences in the focus voltages of the two outer electron beams relative to the center electron beam. Each of the three inline apertures includes a circular center portion with an overlapping (or superimposed) elliptically shaped aperture. The elliptical aperture may be aligned generally vertically or generally horizontally, and the two outer electron beam passing apertures may be larger or smaller in diameter than the center aperture. In the two outer electron beam passing apertures, the superimposed elliptically shaped aperture may be horizontally offset (either outwardly or inwardly relative to the circular center portion) for controlling static convergence of the three electron beams.

12 Claims, 9 Drawing Sheets

COLOR CRT ELECTRON GUN WITH ASYMMETRIC AUXILIARY BEAM PASSING APERTURE

FIELD OF THE INVENTION

This invention relates generally to multi-beam electron guns for use in a color cathode ray tube (CRT) and is particularly directed to a multi-stage, multi-beam common lens electron gun incorporating an asymmetric auxiliary aperture grid in the gun's prefocus lens for correcting for center/outer electron gun interference, electron beam astigmatism, focus voltage differences and static misconvergence.

BACKGROUND OF THE INVENTION

Over time electron guns used in high resolution color CRTs have evolved from the individual type of main lens design to the common lens type design. The former enploys three separate electro-optic lenses, one for each of the three inline electron beams. This type of electron gun suffers from a spatial limitation which gives rise to high spherical aberration and generally poor electron beam spot resolution at high beam current. In the so-called "common lens" design, the three electron beams are directed through a shared aperture as well as through a shared focus region. By increasing the cross sectional size of the electro-optic lens through which the electron beams are directed (without increasing the diameter of the CRTs neck portion), a substantial reduction in spherical aberration, particularly in the horizontal direction, is realized. A single, shared aperture in the common lens is generally elongated in the horizontal direction, somewhat enlarged in the vertical direction, and may assume various shapes such as that of a racetrack, dog bone, or chain-link configuration.

Referring to FIG. 1, there is shown a partially cutaway perspective view of a prior art electron gun 10. The upper right portion of each grid as the electron gun 10 is viewed in tile direction of the CRT's display screen is removed in the figure in order to illustrate the beam passing apertures in these grids. A side elevation view of the electron gun 10 is shown in FIG. 2. Electron gun 10 includes G1 control and G2 screen grids each having three respective inline, beam passing apertures 30*a*, 30*b*, 30*c* and 32*a*, 32*b*, 32*c*. Electron gun 10 further includes a G3 grid having a G31 lower portion and a G32 upper portion. As used herein, the terms "lower portion" or "lower end" refers to the portion or end of a grid facing in the direction of the low voltage portion of the electron gun, i.e., in the direction of the electron gun's cathodes. The terms "higher portion" or "higher end" refers to the portion or end of the grid facing in the direction of the high voltage portion of the electron gun, i.e., in the direction of the CRTs display screen. The G31 lower portion includes three circular beam passing apertures. The G32 upper portion similarly includes three circular apertures each aligned with a respective aperture in the G31 lower portion. Electron gun 10 further includes a flat, plate-like G4 grid having three circular apertures 38*a*, 38*b* and 38*c*. Finally, electron gun 10 includes a G5 and a G6 grid. The G5 grid includes a G52 lower portion and a G55 upper portion, as well as G53 and G54 intermediate portions disposed between and connected to the respective aforementioned upper and lower portions. The G52 lower portion includes three circular apertures, while the G55 upper portion includes a single chainlink-shaped common beam passing aperture. An inner portion of the G5 grid where the G53 and G54 intermediate portions are in abutting contact also includes three circular beam passing apertures. The G6 grid includes a G61 lower portion and a G62 upper portion. The G61 lower portion includes a chainlink-shaped common aperture in facing relation with the G5 grid, while the G62 upper portion includes three circular apertures. Three cathodes, with only one cathode shown as element K in FIG. 2 for simplicity, direct energetic electrons toward the G1 control grid. Three electron beams, with only one electron beam shown in dotted line form in FIG. 2 for simplicity as element 18, are directed through apertures 12*a* in a shadow mask 12 and onto a phosphor coating 14 disposed on the inner surface of a CRT display screen 16. The G1 grid is typically maintained at neutral potential, while a $V_{G2}$ voltage source 20 (in the range of 300–1000 V) is coupled to the G2 and G4 grids. A $V_F$ voltage source 22 (in the range of 20%–32% of the anode voltage $V_A$) is coupled to and provides a focus voltage to the G3 and G5 grids, while a $V_A$ voltage source 24 (approximately 25 kV) provides an accelerating voltage to the G6 grid. Cathodes K, the G1 grid, the G2 grid, and the G31 lower portion of the G3 grid comprise a beam forming region (BFR) 26. The G32 upper portion of the G3 grid in combination with the G4 grid and the G52 lower portion of the G5 grid form a prefocus lens 27. The G55 high end of the G5 grid in combination with the G6 grid form the electron gun's main focus lens 28. The facing chainlink-shaped apertures 66 and 68 respectively in the G55 higher end of the G5 grid and in the G61 lower portion of the G6 grid form a main focusing lens in electron gun 10.

The common main focusing lens approach is not without its own unique design considerations and problems. For example, in the common lens approach it is difficult to equalize the focus voltages of the center and two outer electron beams because the center and outer beams pass through different portions of the common lens aperture and experience different focusing effects in both the horizontal and vertical directions. The problem is compounded by the requirement to provide a horizontal and vertical focus voltage to each of the three electron beams. In the past, the parameters of the beam passing aperture in the common lens have been adjusted to compensate for astigmatism and static misconvergence between the outer electron beams and the center electron beam. For example, the width and S height of the common racetrack aperture; the width, height and outer, or end, radii of the dog bone-shaped aperture; and the radius and pitch between the center and outer electron gun diameters in the chain-link aperture common lens are generally adjusted to provide a compromise between beam astigmatism and convergence between the two outer electron beams and the center electron beam. This approach suffers from interaction between the center and outer electron optics focus lenses, making it difficult to achieve the optimum balanced design for both the center and outer electron guns at the same time.

Another prior art approach employing an auxiliary grid disposed next to the common lens and having elliptical beam passing apertures allows for a certain degree of equalizing of the focus voltages of the center and two outer electron beams. By changing the ellipticity of the apertures in the auxiliary grid, limited control over the focus voltages applied to the center and outer electron beams is possible, permitting limited equalization of the focus voltage applied to the three electron beams. However, because there is interaction between the electron optics focus lenses of adjacent electron beams, it is very difficult to compensate for the astigmatism and focus voltage of one electron beam without adversely affecting these same two parameters in an adjacent electron beam.

The present invention addresses the aforementioned limitations of the prior art by applying a compensating electrostatic field to the three electron beams in a portion of the electron gun where there is virtually no overlap, or interaction, between the electron optics lenses of adjacent electron beams. In this region due the very close spacing between grids where there is no overlap, or interaction, between adjacent electron beam's asymmetric electron optics lenses, it is possible to fine tune the electron gun to correct for electron beam astigmatism and static misconvergence to more easily achieve a balanced optimum performance for the center and two outer electron guns. This invention avoids the "cross-talk" effect between adjacent electron optics lenses of adjacent electron beams through the use of asymmetric beam passing apertures each of which includes a center round portion for guiding a beading mandrel to facilitate grid alignment during electron gun assembly and a superimposed elliptically shaped outer portion.

OBJECTS AND SUMMARY OF THE INVENTION

Accordingly, it is an object of the present invention to provide electron beam astigmatism and static misconvergence correction in a multi-beam electron gun as used in a color CRT.

It is another object of the present invention to utilize the decoupling of the electron optics lenses of adjacent inline electron beams in a multi-beam electron gun in combination with a charged grid, or a pair of charged grids, having asymmetric beam passing apertures disposed in the gun's prefocus lens to facilitate fine tuning of electron gun performance and equalizing the astigmatism and focus voltages of the center and two outer electron beams.

Yet another object of the present invention is to correct for electron beam astigmatism and focus voltage differences as well as static misconvergence by providing a charged grid in an electron gun's prefocus lens with beam passing apertures having a circular center portion adapted for use with a beading mandrel to facilitate grid alignment during electron gun assembly and an outer elliptically shaped portion superimposed on the center circular portion.

This invention contemplates an electron gun for use in a color cathode ray tube, wherein a plurality of inline electron beams are directed onto a display screen for providing a video image, the electron gun comprising: a source of energetic electrons; a beam forming region for forming the energetic electrons into two outer electron beams and a center electron beam disposed intermediate the two outer electron beams. The electron beams are arranged in an inline array and are scanned over the display screen in a raster-like manner. A main focus lens disposed intermediate the beam forming region and the display screen focuses the electron beams on the display screen as the electron beams are scanned over the display screen. The main focus lens includes a common lens for passing and focusing the three electron beams. A prefocus lens is disposed intermediate the beam forming region and the main focus lens and includes a plurality of charged grids each having three inline beam passing apertures. The beam passing apertures in at least one of the grids in the prefocus lens each include a circular center portion for use with a beading mandrel to facilitate grid alignment during electron gun assembly and an outer elliptical portion superimposed on the circular center portion. The close spacing between adjacent grids in the prefocus lens and the asymmetric beam passing apertures in at least one of these grids permits fine tuning of the electron gun to correct for electron beam astigmatism, focus voltage differences, and static misconvergence without "cross-talk" between adjacent electron optics lenses of adjacent electron beams.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawing, where like reference characters identify like elements throughout the various figures, in which:

DETAILED DESCRIPTION OF THE PREFERRED EMBODIMENTS

Figure 3:
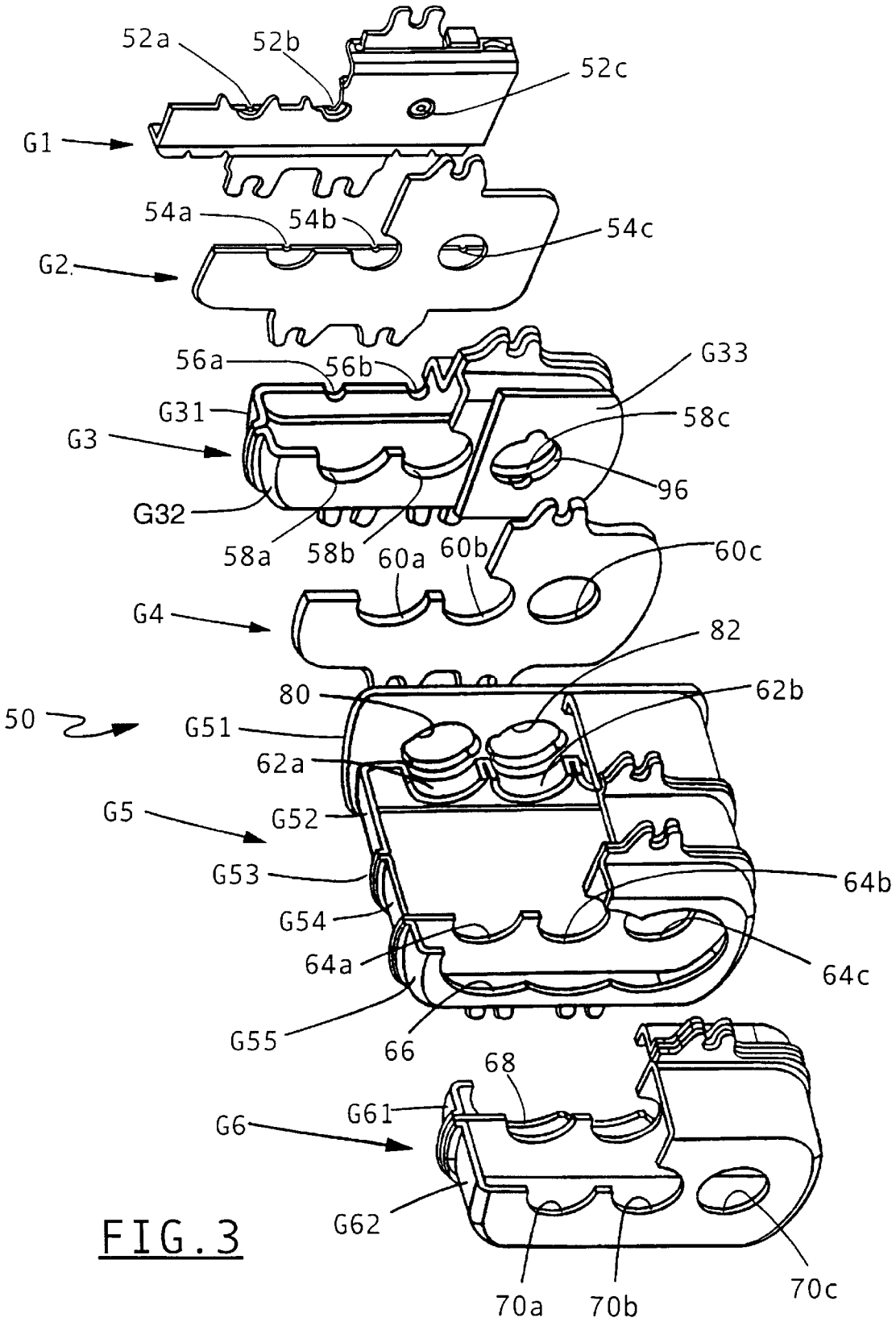
FIG. 3 is a partially cut away perspective view of an electron gun in accordance with one embodiment of the present invention.
Figure 4:
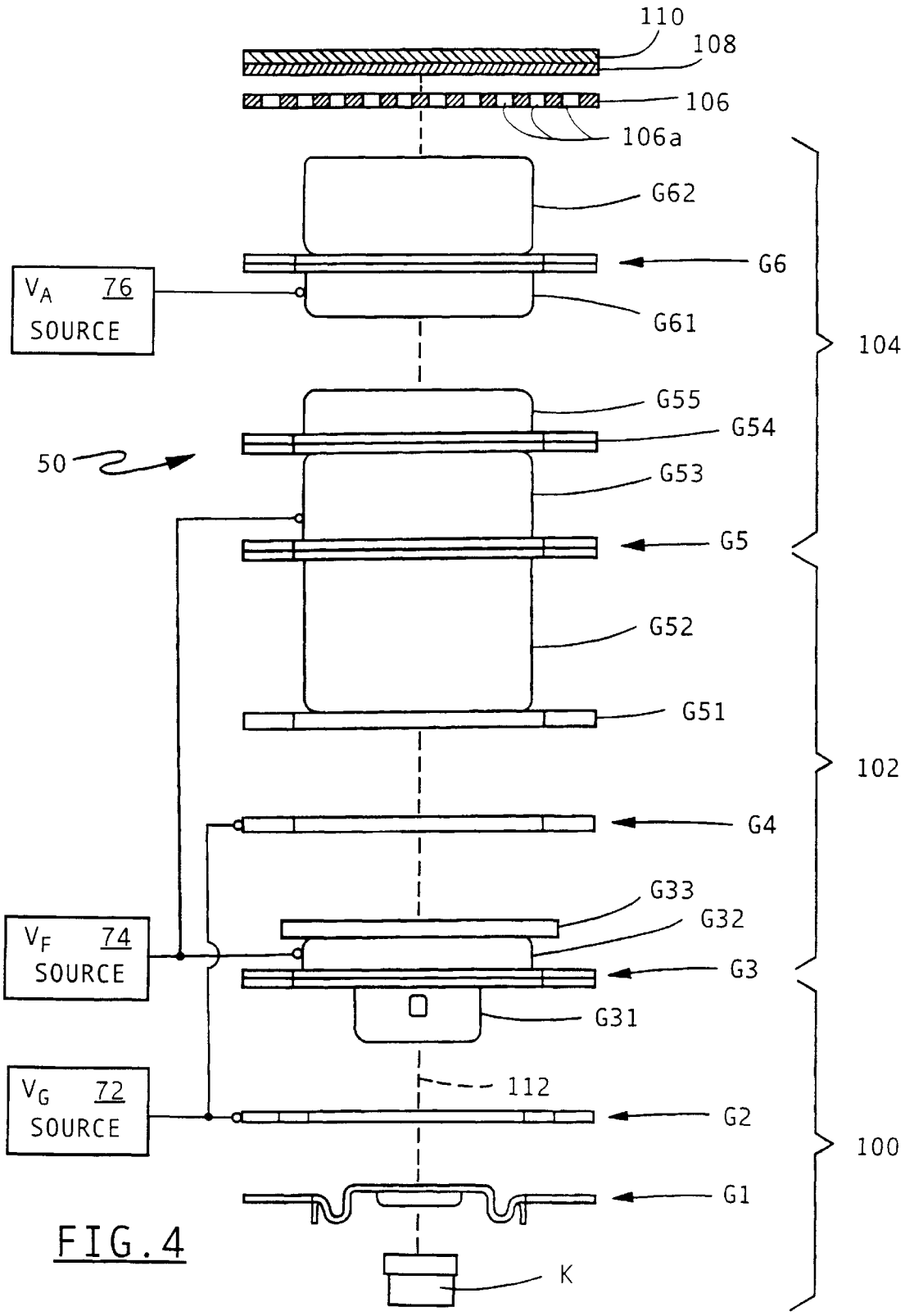
FIG. 4 is a side elevation view of the inventive electron gun of FIG. 3.

Referring to FIG. 3, there is shown a partially cut away perspective view of an electron gun 50 in accordance with one embodiment of the present invention. A side elevation view of the electron gun 50 is shown in FIG. 4. In the embodiment shown in FIGS. 3 and 4, a plate having asymmetric auxiliary beam passing apertures is attached to each of the G3 and G5 grids of the electron gun 50. Another embodiment of the invention described below incorporates the asymmetric auxiliary apertures in the electron gun's G4 grid, while still other embodiments of this invention incorporate the asymmetric auxiliary beam passing apertures directly in either the G3 grid or the G5 grid, or both, in facing relation to the G4 grid without the aforementioned plate. These later embodiments are described below.

Electron gun 50 includes G1, G2, G3, G4, G5 and G6 grids. The G1 control and G2 screen grids are in the general form of flat plates, with the G1 control grid including three inline beam passing apertures 52*a*, 52*b* and 52*c*. The G2 screen grid similarly includes three inline beam passing apertures 54*a*, 54*b* and 54*c*, which apertures are respectively in linear alignment with apertures 52*a*, 52*b* and 52*c* in the G1 control grid. Three cathodes K, with only one shown in FIG. 4 for simplicity, direct energetic electrons in the direction of the G1 control grid and through the three inline apertures 52*a*, 52*b* and 52*c* therein. The G1 control grid is typically maintained at ground potential. The G2 screen grid is coupled to a $V_{G2}$ voltage source 72 and is typically maintained at a voltage on the order of 600 V. In FIG. 3, the G1 control and G2 screen grids, as well as the other grids in electron gun 50, are shown partially cut away in order to illustrate the shape and location of the various beam passing apertures in these grids.

Disposed adjacent to the G2 screen grid is a G3 grid which includes a G31 lower portion and a G32 upper portion. The G31 lower and G32 upper portions of the G3 grid are joined to form a single housing. The terms "lower" and "upper" refer to the relative positions of the two opposed apertured surfaces of the grid, with the lower portion disposed closer to the cathodes K and the upper portion of each of the grids disposed closer to the CRT's display screen 110 as shown in FIG. 4. The G31 lower portion includes three inline circular beam passing apertures in a first end wall, where two of the apertures are shown as elements 56*a* and 56*b* in FIG. 3. The G32 upper portion similarly includes three, inline circular beam passing apertures 58*a*, 58*b* and 58*c* in a second opposed end wall. Joining the aforementioned opposed planar end surfaces, each containing three inline beam passing apertures, is a continuous side wall disposed about the periphery of the G3 grid. The G1 control and G2 screen grids in combination with the G31 lower portion of the G3 grid comprise a beam forming region (BFR) 100 of election gun 50.

The G4 grid is in the form of a generally flat plate and also includes three inline, circular beam passing apertures 60*a*, 60*b* and 60*c*. The G5 grid includes a G52 lower portion, a G55 upper portion, and G53 and G54 intermediate portions disposed between and respectively coupled to the aforementioned lower and upper portions of the grid. Disposed in an end wall of the G52 lower portion are three, circular inline beam passing apertures, where two of these apertures are shown as elements 62*a* and 62*b* in FIG. 3. The juncture between the G54 intermediate portion and G55 upper portion of the G5 grid is also provided with three, circular inline beam passing apertures 64*a*, 64*b* and 64*c*. The G55 upper portion includes a single, chain-link shaped beam passing aperture 66 through which the three inline electron beams pass. The G3 and G5 grids are coupled to and charged by a VF voltage source 74, while the G4 grid is coupled to and charged by the aforementioned $V_G$ voltage source 72 which is also coupled to the G2 screen grid. The G3 and G5 grids are typically maintained at about 7 kV. The G32 upper portion of the G3 grid, the G4 grid, and the G51 lower portion of the G5 grid form, in combination, a prefocus lens 102.

Figure 1:
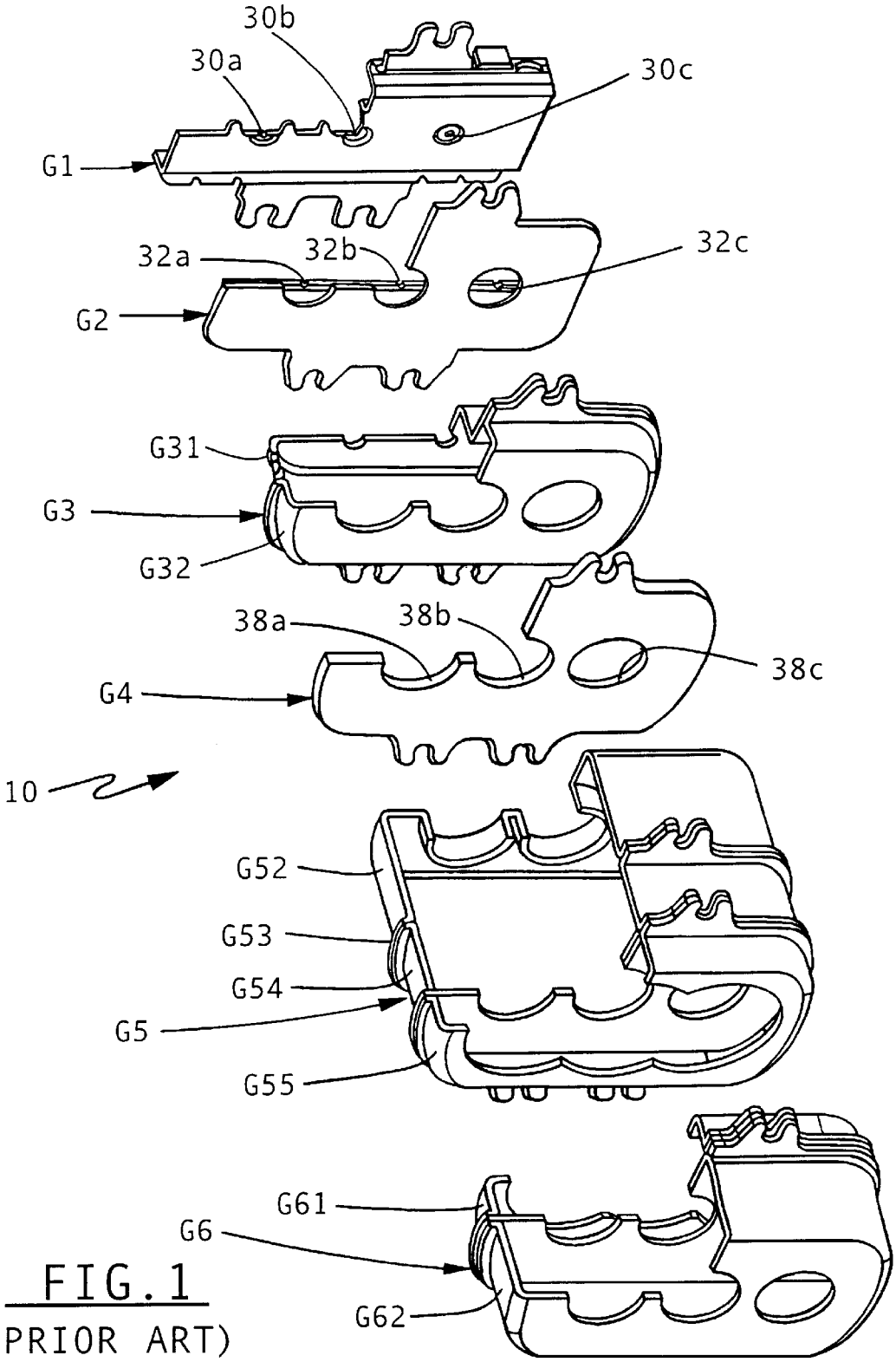
FIG. 1 (PRIOR ART)
FIG. 1 is a partially cut away perspective view of a prior art electron gun.
Figure 2:
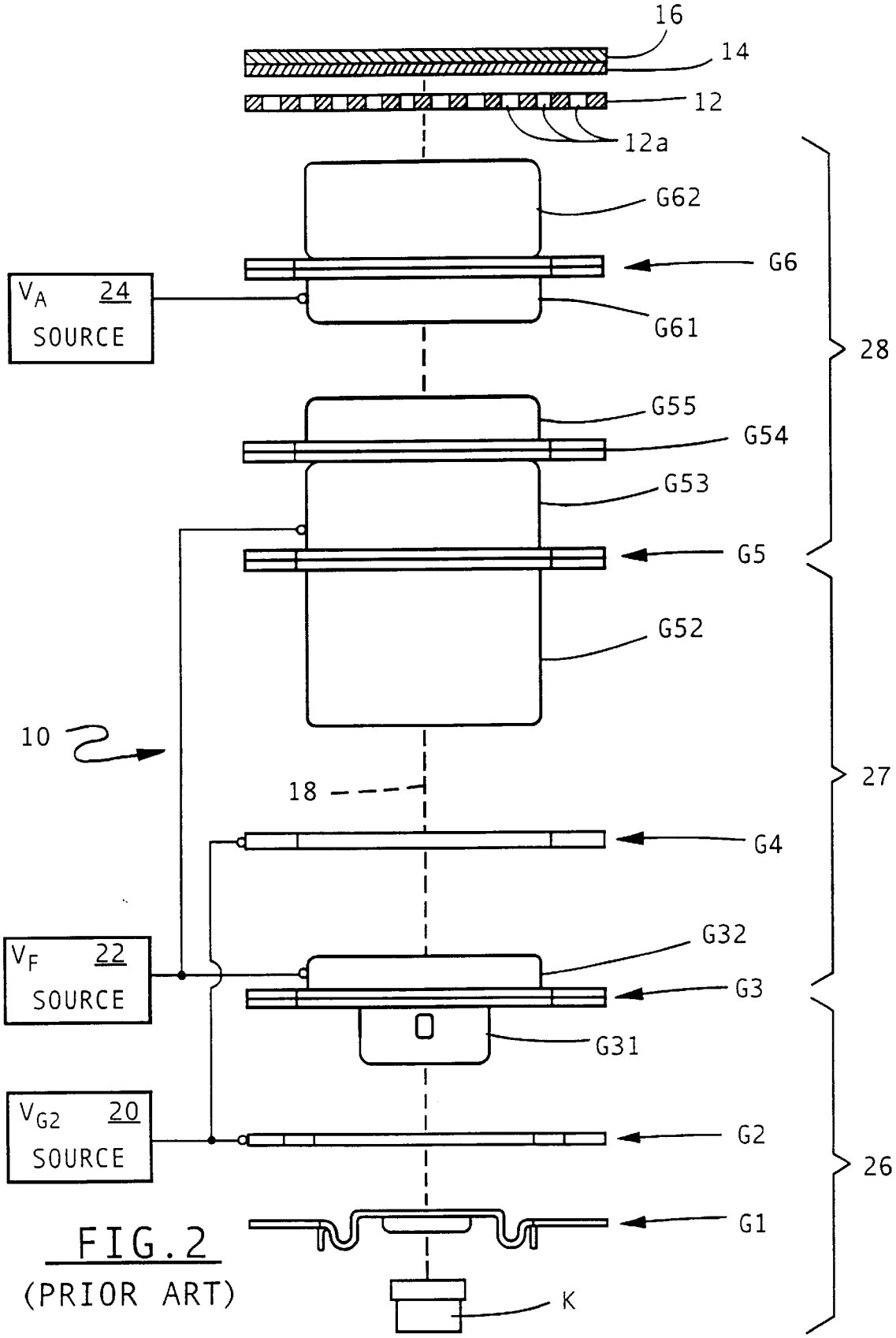
FIG.2 (PRIOR ART)
FIG. 2 is a side elevation view of the electron gun of FIG. 1.

The electron gun 50 further includes the aforementioned G6 grid having a G61 lower portion and G62 upper portion. The G6 grid is coupled to and charged by a $V_A$ voltage source 76 that is typically maintained at a voltage of about 25 kV. The G55 upper portion and G54 and G53 intermediate portions of the G5 grid in combination with the G6 grid form the main focus lens 104 of electron gun 50 for focussing the three electron beams on the CRT's display screen 110. The electron beams 112 (only one of which is shown in FIG. 4 in dotted line form for simplicity) are directed through a plurality of apertures 106*a* within the CRT's shadow mask 106 and then onto a phosphor coating 108 on the inner surface of the CRT's display screen 110. As thus far described, electron gun 50 is identical in operation and configuration to the prior art electron gun 10 described above and shown in FIGS. 1 and 2.

In accordance with this embodiment of the present invention, the inventive electron gun 50 includes an asymmetric auxiliary aperture plate G33 disposed on the upper portion of the G3 grid and an asymmetric auxiliary aperture plate G51 disposed on the lower portion of the G5 grid as shown in FIGS. 3 and 4. The inventive electron gun may also incorporate only one of the aforementioned apertured plates such that another embodiment of an electron gun 50 in accordance with the present invention may incorporate either asymmetric auxiliary aperture plate G33 attached to the upper portion of the G3 grid or the asymmetric auxiliary aperture plate G51 attached to the lower portion of the G5 grid.

Figure 5:
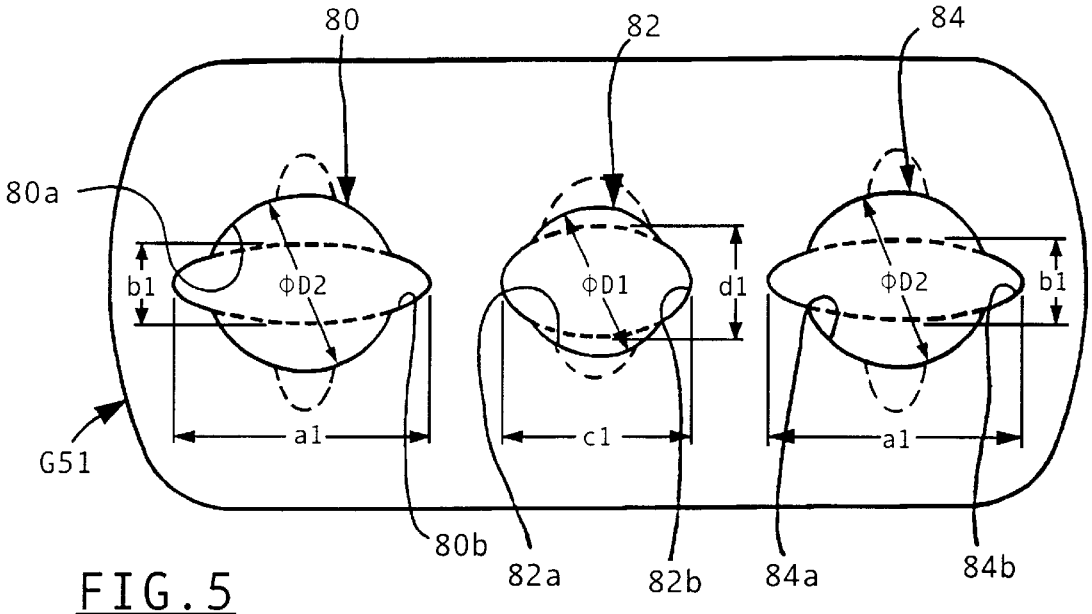
FIG. 5 is a front view of an asymmetric auxiliary aperture plate for use in one embodiment of a color CRT electron gun in accordance with the present invention.
Figure 6:
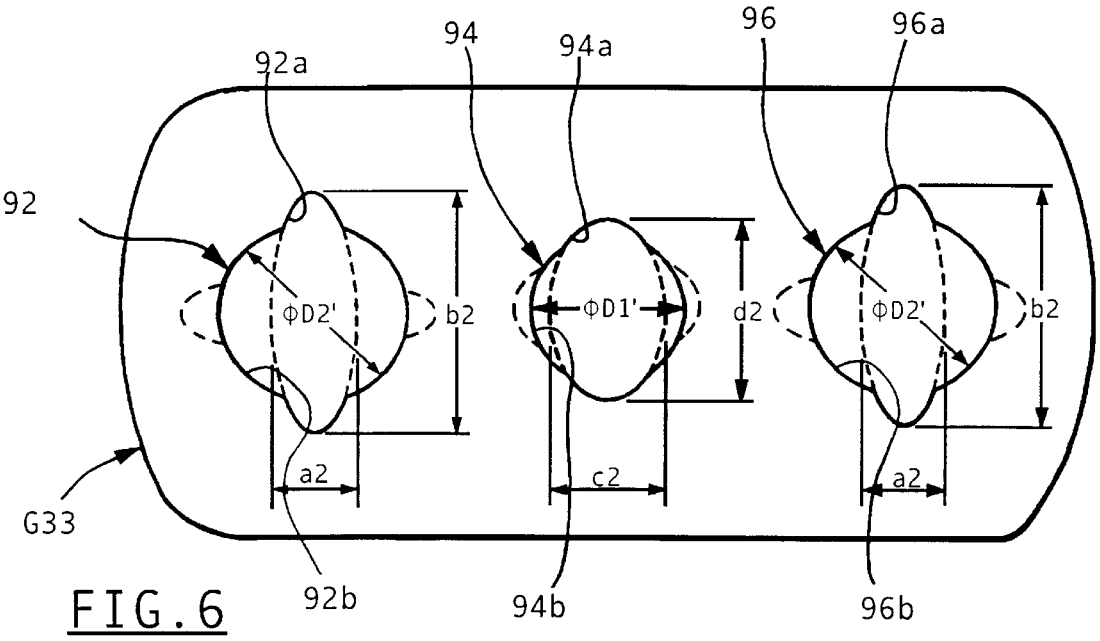
FIG. 6 is another embodiment of an asymmetric auxiliary aperture plate for use in a color CRT electron gun in accordance with the present invention.

Elevation views of the asymmetric auxiliary aperture plates G51 and G33 are respectively shown in FIGS. 5 and 6. The G33 asymmetric auxiliary aperture plate includes three asymmetric apertures 92, 94 and 96 arranged in an inline array, with each of the three aforementioned asymmetric apertures respectively aligned with corresponding circular beam passing apertures 58*a*, 58*b* and 58*c* in the G32 upper portion of the G3 grid. Asymmetric auxiliary aperture plate G33 may be securely attached to the G32 upper portion of the G3 grid by conventional means such as weldments, soldering or brazing. Each of the asymmetric apertures 92, 94 and 96 in the G33 plate includes a respective asymmetric elliptical portion superimposed on a circular center portion of the aperture. Thus, aperture 92 includes an elliptical portion 92*a* superimposed on a circular center portion 92*b* of the aperture. Similarly, apertures 94 and 96 respectively include elliptical portions 94*a* and 96*a* superimposed on circular center portions 94*b* and 96*b* of these apertures. The diameters of the circular center portions of the two outer apertures 92 and 96 are designated as $\phi D2'$ and are equal. Similarly, the diameter of the circular center portion of the center aperture 94 is designated as $\phi D1'$. As shown in FIG. 6, the diameters $\phi D2'$ of the two outer electron beam passing apertures 92,96 are greater than the diameter $\phi D1'$ of the circular center portion of the center aperture 94 in the G33 plate. Also as shown in FIG. 6, the major axes b2 of the elliptical portions 92*a* and 96*a* of the two outer electron beam passing apertures 92,96 are greater in length than the major axis of the elliptical portion 94*a* of the center beam passing aperture 94. The minor axes a2 of the elliptical portions 92*a* and 96*a* of the two outer apertures 92,96 are less than the minor axis c2 of the elliptical portion 94*a* of the center aperture 94. In the G33 plate shown in FIG. 6, the superimposed elliptical portions 92*a*, 94*a* and 96*a* of the three inline apertures 92, 94 and 96 are aligned generally vertically and extend upwardly and downwardly from the respective circular center portions 92*b*, 94*b* and 96*b* of each of these apertures.

The G51 asymmetric auxiliary aperture plate shown in FIG. 5 similarly includes three inline beam passing apertures 80, 82 and 84. Each of the apertures 80, 82 and 84 includes a respective center circular portion 80*a*, 82*a* and 84*a*, where the two outer apertures have a center circular portion with a diameter ϕD2 and the center aperture has a center circular portion with a diameter of ϕD1, where ϕD2>ϕD1. Each of the three inline beam passing apertures 80, 82 and 84 similarly includes a respective elliptical portion 80*b*, 82*b* and 84*b* superimposed on center circular portions 80*a*, 82*a* and 84*a*, respectively. Each of the elliptic portions extend horizontally to the right and left of the aperture's center circular portion. The major axes of the elliptical portions 80*b* and 84*b* of the two outer apertures 80,84 is given as al, while the minor axes of the elliptical portions of these two apertures is given as b1. Similarly, the major axis of the elliptical portion 82*b* of the center aperture 82 is given as c1, while the minor axis is given as d1. As in the case of ϕD2>ϕD1, similarly a1>c1 and d1>b1. The two outer apertures in each of the G33 and G51 plates are thus more asymmetric, i.e., have greater ellipticity, than the associated center aperture in the plate. In addition, while the G33 and G51 asymmetric auxiliary aperture plates are shown with the elliptical portions of their three inline beam passing apertures respectively aligned generally vertically and horizontally, the present invention is not limited to this configuration. Thus, the elliptical portions of the beam passing apertures in the G33 plate may be aligned generally horizontally and the elliptical portions of the beam passing apertures in the G51 plate may be aligned generally vertically, or the elliptical portions of the beam passing apertures in both the G33 and G51 plates may all be aligned either vertically or horizontally. In addition, the elliptical portions of the bean passing apertures in a given grid may have different orientations, i.e., some aligned vertically and some aligned horizontally. This is shown in FIG. 6 where the two outer apertures 92 and 96 are shown with respective vertically aligned elliptical portions 92*a* and 96*a* and also, in an alternative embodiment, horizontally aligned elliptical portions (shown in dotted line form). Thus, the elliptical portions of the two outer electron beam passing apertures 92 and 96 in the G33 plate shown in FIG. 6 may both be aligned either vertically or horizontally. Moreover, the elliptical portions of all three beam passing apertures 92, 94 and 96 in the G33 plate may be aligned horizontally as shown in dotted line form in FIG. 6. This latter embodiment of the G33 plate may be used in combination with the G51 plate as shown partially in dotted line form in FIG. 5 wherein the elliptical portions of the three beam passing apertures 80, 82 and 84 are shown aligned generally vertically. Only the elliptical portions of the two outer apertures must be aligned in the same direction, either both aligned vertically or horizontally.

Figure 7A:
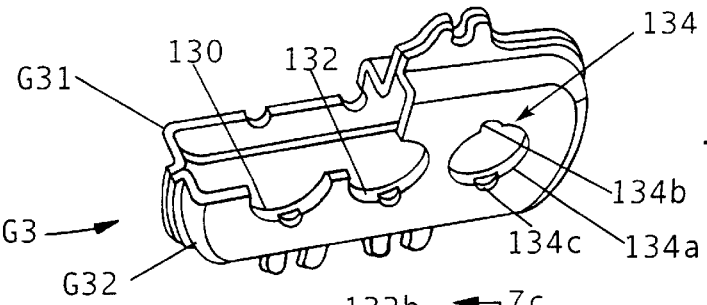
FIGS. 7*a*, 7*b* and 7*c* are respectively partially cutaway perspective, front elevation, and sectional views of another embodiment of a G3 grid for use in the present invention.
Figure 7B:
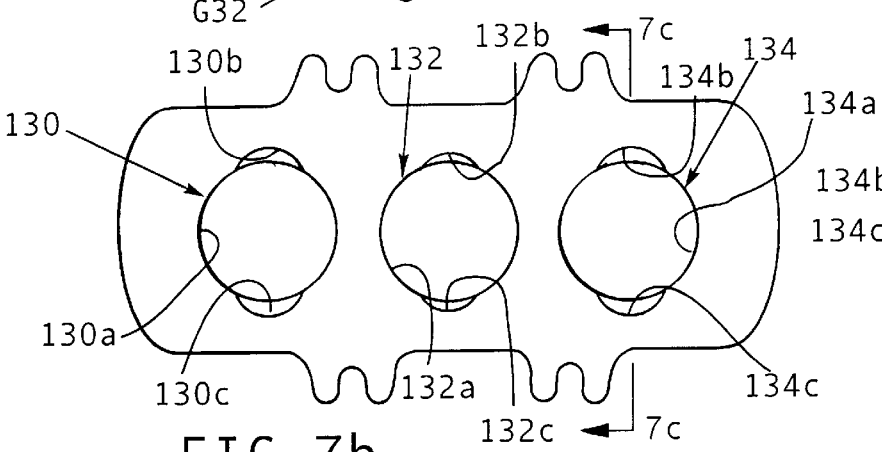
Figure 7C:
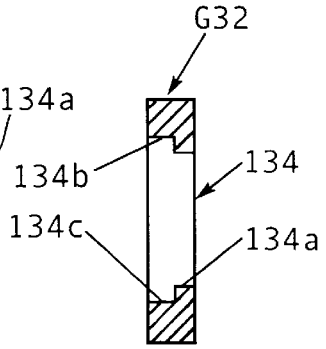

Referring to FIG. 7*a*, there is shown a partially cut away perspective view of another embodiment of a G3 grid in accordance with the present invention. FIG. 7*b* is an elevation view of the G3 grid shown in FIG. 7*a*, while FIG. 7*c* is a sectional view taken along site line 7*c*–7*c* in FIG. 7*b* of a wall, or partition, in the G3 grid which includes a plurality of inline asymmetric beam passing apertures 130, 132 and 134. In the embodiment of the invention shown in FIGS. 7*a*, 7*b*, and 7*c*, each of the beam passing apertures 130, 132 and 134 is disposed in a single wall within the G3 grid unlike in the previously described embodiment where a circular center portion of the beam passing aperture is disposed in the first wall of the grid, while the asymmetric elliptical portion of the beam passing aperture is disposed in a second wall, or plate, disposed immediately adjacent to the first wall.

Each of the three inline beam passing apertures 130, 132 and 134 in the G3 grid includes a respective circular center portion 130*a*, 132*a* and 134*a*. Disposed in the wall of the G3 grid containing the inline beam passing apertures 130, 132 and 134 and extending outwardly from each of these apertures is a pair of opposed notches. Thus, the outer surface of the wall in which the three beam passing apertures 130, 132 and 134 are disposed includes respective pairs of opposed notches 130*b* and 130*c*, 132*b* and 132*c*, and 134*b* and 134*c* extending outwardly from the circular center portions of these apertures. As shown in the figures, each pair of notches 130*b*, 130*c* and 132*b*, 132*c* and 134*b*, 134*c* is disposed on the outer surface of the end wall of the G3 grid in facing relation to the electron gun's G4 grid (not shown for simplicity), with each pair of notches aligned generally vertically in the grid wall.

Figure 8A:
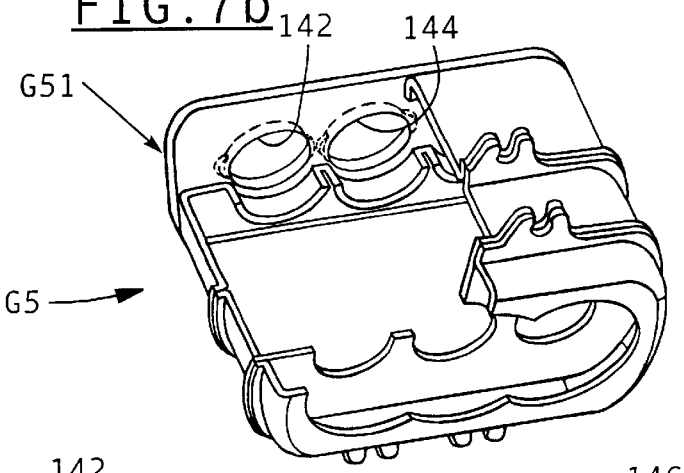
FIGS. 8*a*, 8*b* and & are respectively partially cutaway perspective and sectional views of another embodiment of a G5 grid for use in the present invention.
Figure 8B:
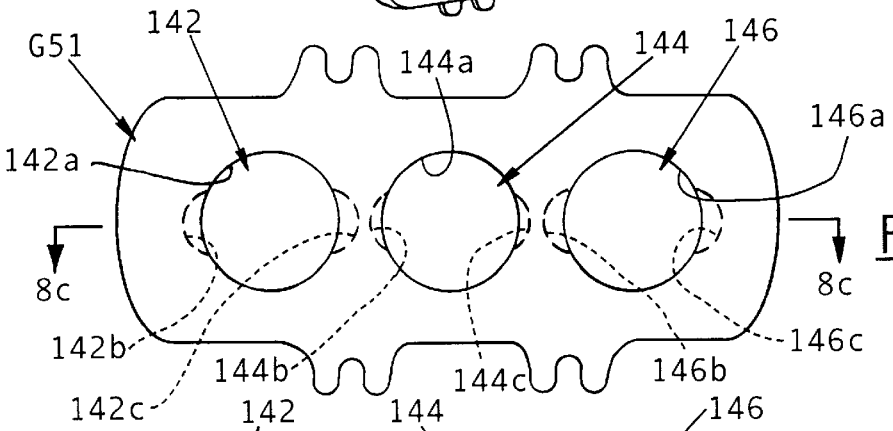
Figure 8C:
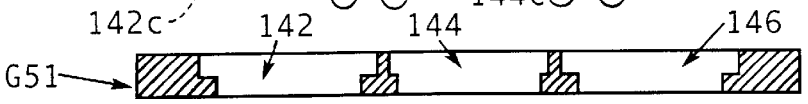

Referring to FIG. 8*a*, there is shown a partially cut away perspective view of another embodiment of a G5 grid in accordance with the present invention. An elevation view of the G51 end wall of the G5 grid is shown in FIG. 8*b*, while a sectional view of the grid end wall taken along site line 8*c*—8*c* in FIG. 8*b* is shown in FIG. 8*c*. The G51 end wall of the G5 grid includes three inline beam passing apertures 142, 144 and 146. Beam passing apertures 142, 144 and 146 each include a respective circular center portion 142*a*, 144*a* and 146*a*. Beam passing aperture 142 includes opposed notches 142*b* and 142*c* extending outwardly from the circular center portion 142*a* of the aperture. Similarly, beam passing apertures 144 and 146 respectively include opposed pairs of notches 144*b*, 144*c* and 146*b*, 146*c* extending outwardly from these apertures. Each of the respective pairs of opposed notches in apertures 142, 144 and 146 are disposed on the outer surface of the G51 portion of the G5 grid in facing relation to the G4 grid (not shown) and are aligned generally horizontally or along the length of the G51 end wall of the grid. The notched, asymmetric auxiliary beam passing apertures in the G3 and G5 grids shown in FIGS. 7*a*–7*c* and 8*a*–8*c* allow for correcting of center and outer electron gun interference, electron beam astigmatism and focus voltage differences between the center and outer electron guns.

Figure 9A:
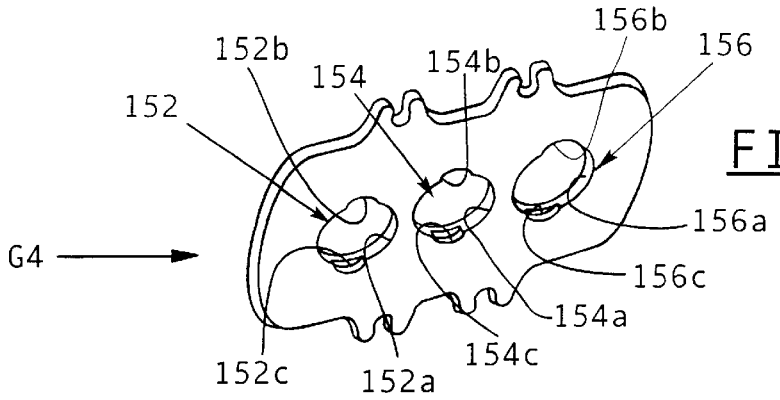
FIGS. 9*a*, 9*b*, 9*c* and 10*a*, 10*b*, 10*c* are respectively perspective, front elevation, and sectional views of two embodiments of a G4 grid for use in another embodiment of the present invention.
Figure 9B:
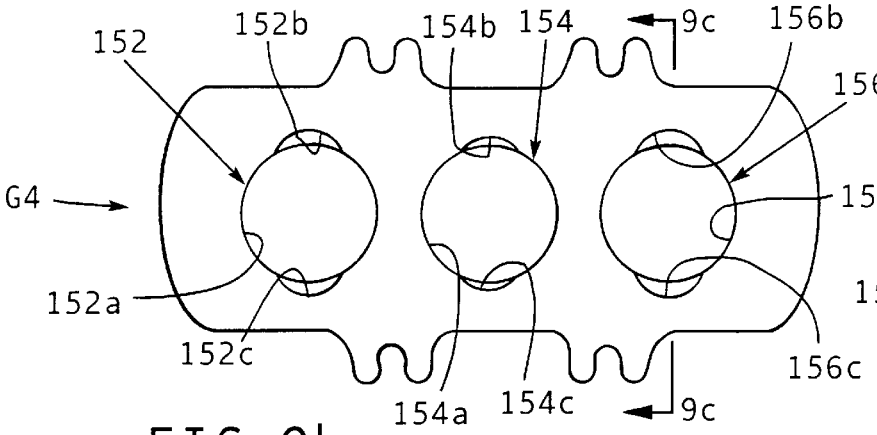
Figure 9C:
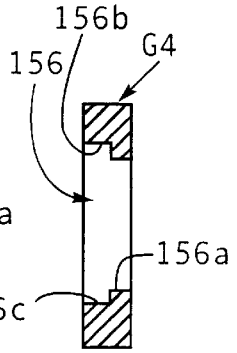

Referring to FIG. 9*a*, there is shown a perspective view of a G4 grid in accordance with another embodiment of the invention. FIG. 9*b* is an elevation view of the G4 grid shown in FIG. 9*a*, while FIG. 9*c* is a sectional view of the G4 grid taken along site line 9*c*–9*c*: in FIG. 9*b*. G4 grid includes three inline beam passing apertures 152, 154 and 156. Each of the three inline beam passing apertures 152, 154 and 156 includes a respective circular center portion 152*a*, 154*a* and 156*a*. Aperture 152 further includes first and second peripheral notched portions 152*b* and 152*c* on diametrically opposed portions of the circular center portion 152*a* of the aperture. Similarly, beam passing apertures 154 and 156 include respective pairs of opposed notches 154*b*, 154*c* and 156*b*, 156*c* in opposed portions of the circular center portions 154*a* and 156*a* of these apertures. The notched portions in each of the three inline beam passing apertures 152, 154 and 156 in the embodiment shown in FIGS. 9*a*–9*c* are aligned generally vertically.

Figure 10A:
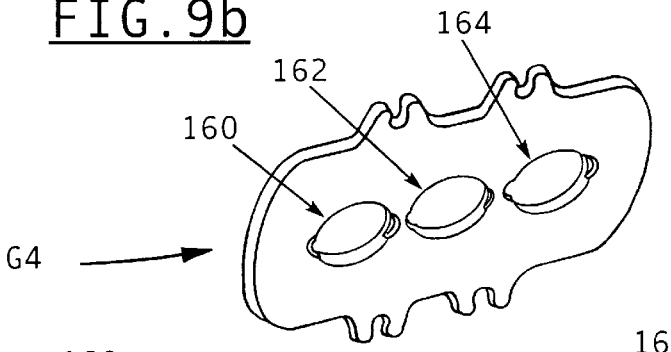
Figure 10B:
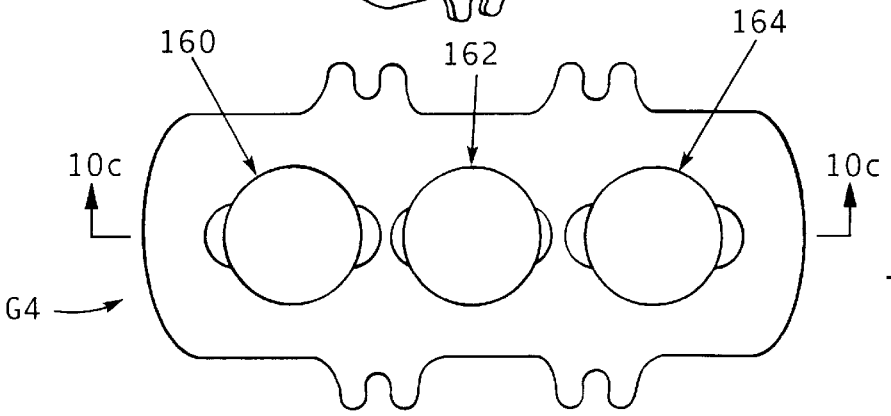
Figure 10C:
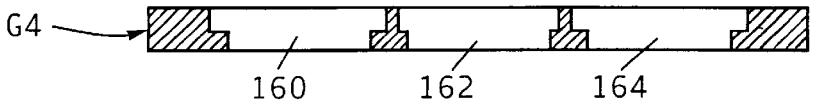

Referring to FIG. 10*a*, there is shown a perspective view of another embodiment of a G4 grid in accordance with the present invention. An elevation view of the G4 grid of FIG. 10*a* is shown in FIG. 10*b*, while a sectional view of the G4 grid as shown in FIG. 10*b* taken along site line 10*c*—10*c* therein is shown in FIG. 10*c*. In the G4 grid shown in FIGS. 10*a*–10*c* each of the notched portions in the three inline electron beam passing apertures 160, 162 and 164 are shown generally horizontally aligned along the longitudinal axis of the G4 grid. In the two embodiments of the G4 grid shown in FIGS. 9*a*–9*c* and 10*a*–10*c*, the opposed notched portions in each of the three beam passing apertures are located in one of the surfaces of the grid. The surface containing the notched portions of the beam passing apertures in the G4 grid may be in facing relation to either the adjacent G3 grid or to the adjacent G5 grid. The notched portions in each of the asymmetric beam passing apertures in the G4 grid will operate equally as well in correcting for electron beam astigmatism and focus voltage differences in either orientation. However, the notched portions in the three inline beam passing apertures in the G3 or G5 grids, as described above, must be in facing relation to the G4 grid for proper operation of this invention.

Figure 11A:
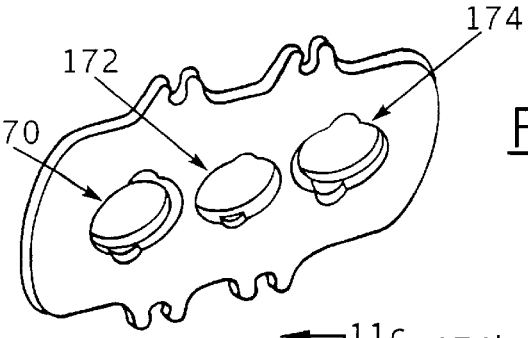
FIGS. 11*a*, 11*b*, 11*c* and 12*a*, 12*b*, 12*c* are respectively perspective, front elevation and sectional views of two additional embodiments of a G4 grid having horizontally offset elliptical portions in the two outer beam passing apertures.
Figure 11B:
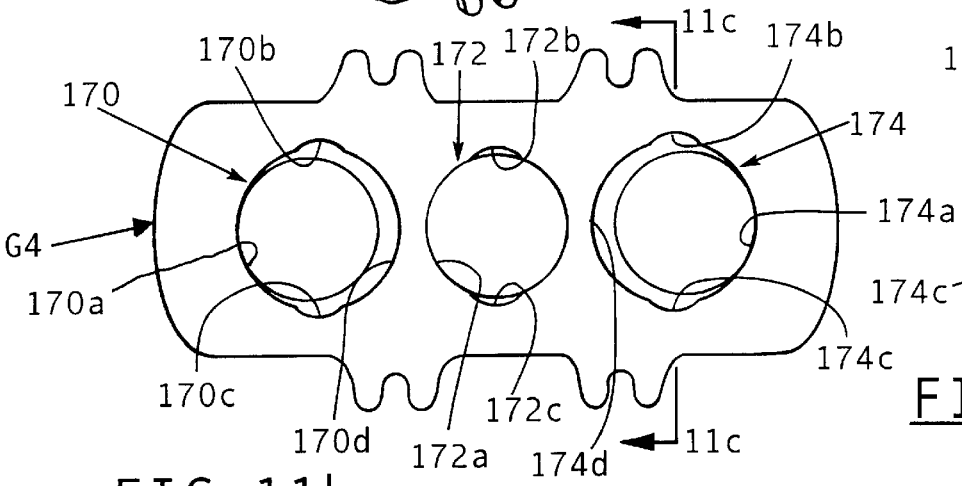
Figure 11C:
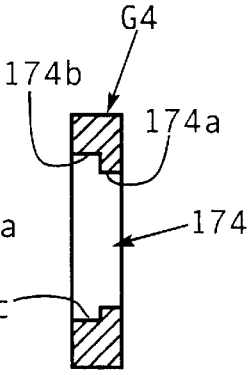

Referring to FIG. 11*a,* there is shown a perspective view of yet another embodiment of a G4 grid in accordance with the principles of the present invention. FIG. 10*b* is an elevation view of the G4 grid shown in FIG. 11*a,* while FIG. 11*c* is a sectional view of the G4 grid as shown in FIG. 11*b* taken along site line 11*c*–11*c* therein. In the G4 grid shown in FIGS. 11*a*–11*c,* each of the three inline beam passing apertures 170, 172 and 174 includes a respective circular center portion 170*a*, 172*a* and 174*a*. In addition, each of the beam passing apertures 170, 172 and 174 includes a respective circular offset portion having a pair of opposed notches therein. Thus, aperture 170 includes a circular center portion 170*a* and a circular offset portion 170*d* having upper and lower opposed notches 170*b* and 170*c* therein. The circular offset portion 170*d* is disposed slightly inwardly from the circular center portion 170*a* of the aperture in the direction of the center aperture 172. Similarly, the second outer electron beam passing aperture 174 includes a circular center portion 174*a* and a circular offset portion 174*d* having opposed upper and lower notches 174*b* and 174*c* therein. The circular offset portion 174*d* is displaced inwardly from the axis of the aperture's circular center portion 174*a* toward the center electron beam passing aperture 172. The center beam passing aperture 172 includes a circular center portion 172*a* and upper and lower opposed notches 172*b* and 172*c* therein. The center beam passing aperture 172 does not include the circular offset portion as do the two outer electron beam passing apertures 170, 174. The circular offset portions 170*d*, 174*d* respectively of the first and second outer electron beam passing apertures 170, 174 allow for adjustment of the static convergence of the two outer electron beams with the center electron beam on the CRT's display screen.

Figure 12A:
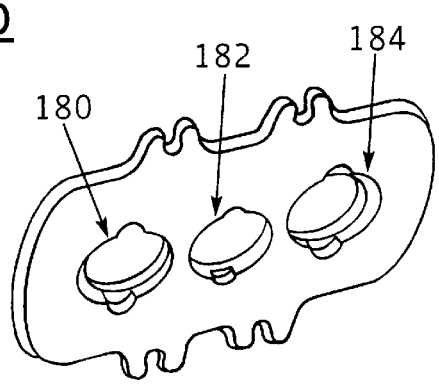
Figure 12B:
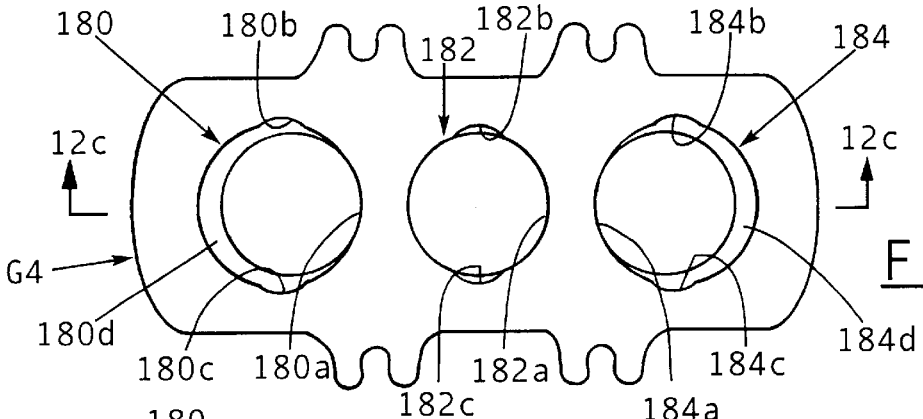
Figure 12C:
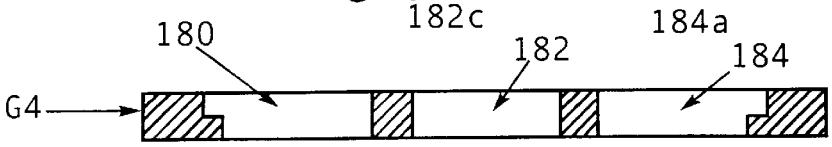

Referring to FIG. 12*a*, there is shown a perspective view of yet another embodiment of a G4 grid in accordance with the principles of the present invention. An elevation view of the G4 grid illustrated in FIG. 12*a* is shown in 12*b*, while a sectional view of the G4 grid taken along site line 12*c*–12*c* in FIG. 12*b* is shown in FIG. 12*c*. The G4 grid shown on FIGS. 12*a*–12*c* also includes three inline electron beam passing apertures 180, 182 and 184. In this embodiment, the two outer electron beam passing apertures 180, 184 include respective circular center portions 180*a* and 184*a* as well as respective circular offset portions 180*d* and 184*d*. The circular offset portions 180*d* and 184*d* are displaced from the center axis of the aperture's circular center portion in a direction away from the center electron beam passing aperture 182. As in the earlier described embodiment, the first electron beam passing aperture 180 also includes upper and lower opposed notches 180 and 180*c* in its circular offset portion 180*d*. Similarly, the second outer electron beam passing aperture 184 includes upper and lower opposed notches 184*b* and 184*c* in its circular offset portion 184*d*. The center electron beam passing aperture 182 includes a circular center portion 182*a* and opposed upper and lower notches 182*b* and 182*c*. All of the aforementioned notches are in a surface of the G4 grid immediately adjacent to an aperture in the grid. The aforementioned notches allow for correcting of astigmatism as well as focus voltage differences in the electron beams, while the circular offset portions of the two outer electron beam passing apertures allow the beams to be statically converged to a single point on the CRT's display screen.

Figure 13A:
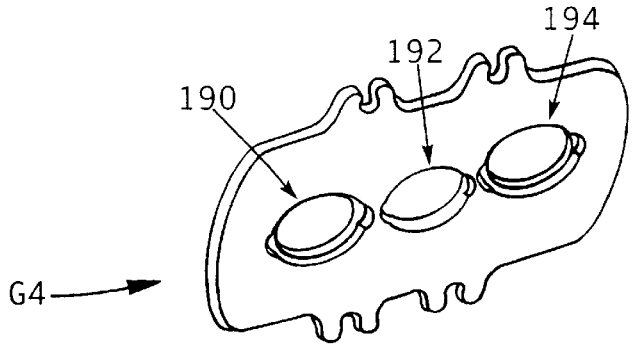
FIGS. 13*a*, 13*b*, 13*c* and 13*d* are respectively perspective, front elevation, vertical sectional, and horizontal sectional views of yet another embodiment of a grid for use in the prefocus lens of a multi-beam electron gun in accordance with the present invention.
Figure 13B:
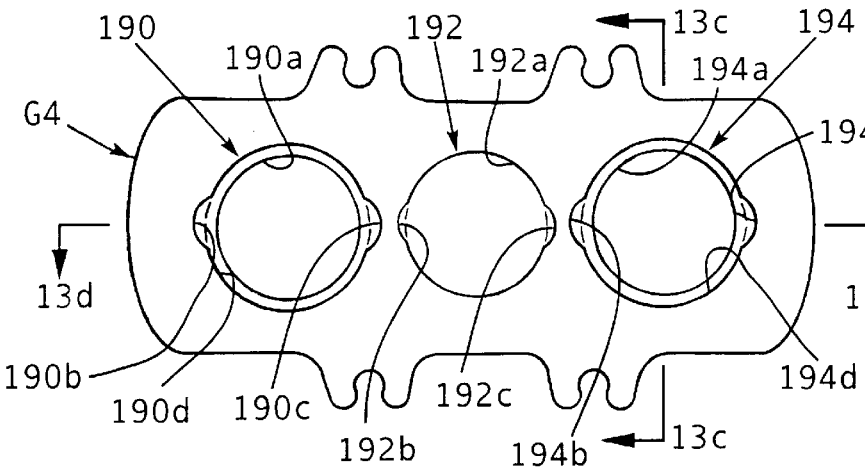
Figure 13C:
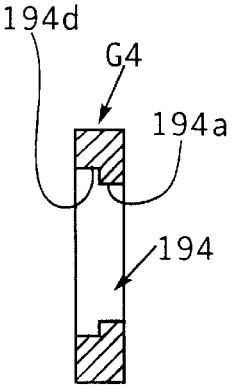
Figure 13D:
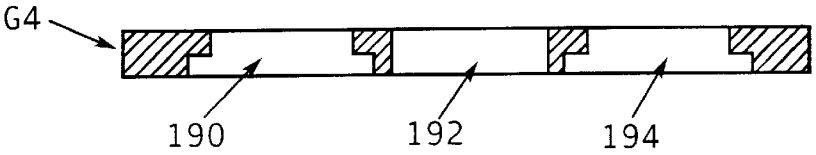

Referring to FIG. 13*a*, there is shown a perspective view of yet another embodiment of a G4 grid in accordance with the present invention. An elevation view of the G4 grid of FIG. 13*a* is shown in FIG. 13*b*. FIGS. 13*c* and 13*d* are sectional views of the G4 grid shown in FIG. 13*b* taken along site lines 13*c*–13*c* and 13*d*–13*d*, respectively. As in the previous embodiments, the G4 grid shown in FIGS. 13*a*–13*d* includes three inline electron beam passing apertures 190, 192 and 194. The center aperture 192 includes a circular center portion 192*a* and a pair of notches 192*b* and 192*c* extending from opposed lateral portions of the aperture and disposed in a surface of the plate-like G4 grid. The two outer electron beam passing apertures 190, 194 include a circular center portion 190*a* and 194*a* and a circular outer portion 190*d* and 194*d*. The circular outer portions 190*d*, 194*d* are coaxially aligned with their respective circular center portions 190*a*, 194*a*. Each of the circular outer portions 190*d*, 194*d* is disposed in a surface of the G4 grid and includes a pair of opposed notches. Thus, the circular outer portion 190*d* of the first outer electron beam passing aperture 190 includes opposed notches 190*b* and 190*c* disposed in a surface of the G4 grid and extending radially outward from the circular outer portion. Similarly, the second outer electron beam passing aperture 194 includes first and second opposed notches 194*b* and 194*c* extending outwardly from its circular outer portion 194*d*. The circular outer portions and the opposed notches therein of each of the two outer apertures 190, 194 allow for electron beam astigmatism correction as well as for correcting for focus voltage differences between the electron beams.

There has thus been shown a multi-beam electron gun for a color CRT having a prefocus lens incorporating G3, G4 and G5 grids. Three inline asymmetric beam passing apertures are provided either in the G4 grid or in the upper side of the G3 grid and/or lower side of the G5 grid, i.e., in facing relation to the G4 grid. The asymmetric beam passing apertures each include respective elliptical portions or notches extending outwardly from a circular center portion of the aperture. The elliptical portions or notches of the beam passing apertures in a given grid may all be aligned either horizontally or vertically. The asymmetric shape of the beam passing apertures allows for correction of center/outer electro-optic lens interference and permits the asymmetric and independent correction for electron beam astigmatism, i.e., the difference between the beam's horizontal and vertical focus voltage, of the two outer electron beams relative to the center electron beam. This arrangement also facilitates fine tuning the electron gun because of the relatively low sensitivity of beam astigmatism and focus voltage to the size and shape of the asymmetric beam passing apertures. The elliptical portions or notches of the two outer electron beam passing apertures may be offset from the axis of the aperture's circular center portion either inwardly toward the center beam passing aperture or outwardly to correct for static misconvergence of the three electron beams.

While particular embodiments of the present invention have been shown and described, it will be obvious to those skilled in the art that changes and modifications may be made without departing from the invention in its broader aspects. For example, while the present invention is disclosed as incorporated in an electron gun having a dynamic quadrupole for focusing the electron beams, this invention is not limited to use in this type of electron gun but could be incorporated in virtually any of the more commonly used electron guns. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An electron gun for use in a color cathode ray tube, wherein a plurality of inline electron beams are directed onto a display screen for providing a video image, said electron gun comprising:

a source of energetic electrons;

beam forming means for forming said energetic electrons into two outer electron beams and a center electron beam disposed intermediate said two outer electron beams, wherein said electron beams are arranged in an inline array and are scanned over the display screen in a raster-like manner;

a main focus lens disposed intermediate said beam forming means and the display screen and including a common lens for passing and focusing the two outer electron beams and the center electron beam on the display screen as the electron beams are scanned over the display screen; and a prefocus lens disposed intermediate said beam forming means and said main focus lens and including an upper side of a G3 grid, a lower side of a G5 grid, and a G4 grid disposed intermediate said G3 and G5 grids and in facing relation to the respective upper and lower sides of said G3 and G5 grids, wherein said G3, G4 and G5 grids are in closely spaced relation and said G3 grid is disposed intermediate said beam forming means and said G4 grid and said G5 grid is disposed intermediate said G4 grid and said main focus lens, and wherein said G4 grid is maintained at a first voltage and said G3 and G5 grids are maintained at a second voltage, wherein said second voltage is greater than said first voltage, and wherein each of said G3, G4 and G5 grids includes two outer and one center inline electron beam passing apertures, with each aperture in said G3 grid aligned with respective apertures in said G4 and G5 grids for passing a respective electron beam, wherein the outer and center inline electron beam passing apertures in at least one of said upper side of the G3 grid and said lower side of the G5 grid include a circular center portion and an elliptically shaped portion superimposed on said circular center portion for correcting for astigmatism and focus voltage differences of the electron beams, wherein each elliptical portion superimposed on an associated circular center portion of a beam passing aperture has a major axis greater than a diameter of said circular center portion and a minor axis less than the diameter of said circular center portion, wherein the superimposed elliptical portions of at least one of said beam passing apertures in a given grid are aligned generally vertically and the superimposed elliptical portions of at least one other of said beam passing apertures in said given grid are aligned generally horizontally.

2. The electron gun of claim 1 wherein the circular center portions of said two outer electron beam passing apertures are generally equal in diameter and are different in diameter than the circular center portion of said center beam passing aperture.

3. The electron gun of claim 1 wherein all of the superimposed elliptical portions of said center and two outer beam passing apertures in a given grid are aligned generally vertically or horizontally.

4. The electron gun of claim 1 wherein the spacing between said G4 grid and said G3 and G5 grids is on the order of 1.0 mm.

5. The electron gun of claim 1 wherein the elliptically shaped portions of said two outer electron beam passing apertures are horizontally offset from an axis of the circular center portion of the associated electron beam passing aperture either inwardly toward said center beam passing aperture or outwardly away from said center beam passing aperture for statically converging the two outer electron beams and the center electron beam on the display screen.

6. The electron gun of claim 1 wherein an upper side of said G3 grid and a lower side of said G5 grid each include two outer and one center inline beam passing apertures each having a circular center portion and an elliptically shaped portion superimposed on said circular center portion.

7. The electron gun of claim 6 wherein all of the elliptical portions of said center and two outer asymmetric apertures in said G3 grid are aligned generally vertically and the elliptical portions of said center and two outer asymmetric apertures in said G5 grid are aligned generally horizontally.

8. The electron gun of claim 6 wherein all of the elliptical portions of said center and outer asymmetric apertures in said G3 grid are aligned generally horizontally and the elliptical portions of said center and two outer asymmetric apertures in said G5 grid are aligned generally vertically.

9. In a multi-beam electron gun for use in a color cathode ray tube, wherein a plurality of inline electron beams are directed onto a display screen for providing a video image, said electron gun including an electron beam forming region for forming a plurality of spaced, inline electron beams, a prefocus lens disposed intermediate said beam forming region and said display screen, wherein said prefocus lens includes high voltage G3 and G5 grids and a low voltage G4 grid disposed intermediate said G3 and G5 grids, and a main focus lens disposed intermediate said prefocus lens and said display screen for focusing the electron beams on said display screen, a grid for use in said prefocus lens, said grid comprising:

a generally flat plate; and means for defining a center and two outer inline apertures in said flat plate, wherein a respective electron beam is directed through each of said center and two outer apertures, and wherein each of said apertures includes a circular center portion and an elliptically shaped portion superimposed on said circular center portion for correcting for astigmatism and focus voltage differences of the electron beams, wherein said grid forms an upper end portion of a G3 grid or a lower portion of a G5 grid, wherein at least one of the superimposed elliptical portions of the center and two outer apertures in said plate is aligned generally vertically and at least one of said superimposed elliptical portions is aligned generally horizontally.

10. The grid of claim 9 wherein each of said asymmetrically shaped portions of each of said apertures includes an elliptical portion superimposed on an associated circular center portion of the aperture and having a major axis greater than a diameter of said generally circular center portion and a minor axis less than the diameter of said circular center portion.

11. The grid of claim 9 wherein the circular center portion of said center aperture in said generally flat plate is smaller or larger in diameter than the circular center portions of said two outer apertures.

12. The grid of claim 9 wherein all of the superimposed elliptical portions of the center and two outer asymmetric apertures in said plate are aligned generally vertically or horizontally.

* * * * *

UNITED STATES PATENT AND TRADEMARK OFFICE

CERTIFICATE OF CORRECTION

PATENT NO. : 6,153,970
DATED : Nov. 28, 2000
INVENTOR(S) : Hsing-Yao Chen, et al It is certified that error appears in the above-identified patent and that said Letters Patent is hereby corrected as shown below:

| COLUMN | LINE | |
|---|---|---|
| 1 | 39 | change "tile" to --the-- |
| 2 | 42 | delete "S" |
| 5 | 57 | change "VF" to --$V_F$ – |

Signed and Sealed this

Eighth Day of May, 2001

*Attest:*

Nicholas P. Godici

NICHOLAS P. GODICI

*Attesting Officer*

*Acting Director of the United States Patent and Trademark Office*